US006131205A

United States Patent [19]

Arem

[11] Patent Number: 6,131,205

[45] Date of Patent: Oct. 17, 2000

[54] INVISIBLE POCKET

[76] Inventor: Valerie Michelle Arem, 9734 Liparai Cir., Cypress, Calif. 90630

[21] Appl. No.: 09/354,912

[22] Filed: Jul. 9, 1999

[51] Int. Cl.[7] ..... A41D 27/20

[52] U.S. Cl. ..... 2/250; 2/247; 2/244

[58] Field of Search ..... 2/247, 249, 250, 2/244, 94

[56] References Cited

U.S. PATENT DOCUMENTS

| | | | |
|---|---|---|---|
| 4,876,724 | 10/1989 | Suzuki | 2/94 |
| 5,127,565 | 7/1992 | Grant | 224/196 |
| 5,809,576 | 9/1998 | Huston et al. | 2/247 |
| 5,870,777 | 2/1999 | Hans | 2/238 |
| 5,901,372 | 5/1999 | Lawler | 2/69 |
| 5,956,775 | 9/1999 | Ezra | 2/227 |

OTHER PUBLICATIONS

Khalje, Bridal Couture, pp. 3126–3127, 1997.
Kling, The Artful Ribbon, p. 177, 1996.

*Primary Examiner*—Bibhu Mohanty
*Attorney, Agent, or Firm*—Fulbright & Jaworski

[57] ABSTRACT

The present invention provides an invisible pocket for suspending a decorative item or embellishment on a garment. The pocket of the invention is typically constructed of sheer fabric and may be any size necessary to receive any desired item to be suspended on the garment.

18 Claims, 2 Drawing Sheets

INVISIBLE POCKET

BACKGROUND OF THE INVENTION

1. Field of the Invention

The present invention relates to the field of garment design and production. More specifically, the present invention relates to suspending decorative items, such as flowers, on a garment in such a way that the method of suspension cannot be detected except by close examination. In general, an embellishment is suspended on a sheer fabric without the use of adhesives or permanent stitching.

2. Description of Related Art

In the field of garment design and production, especially for more formal garments such as wedding gowns and other formal gowns, it is often desirable to suspend decorative items, such as flowers, on the exterior or surface of the gown. In the past, this has been accomplished several ways. For example, traditional methods for attaching a decorative item to a garment have included gluing, pinning or stitching the item directly to the garment. Each of these methods has disadvantages.

In one sense, whenever a decorative item is itself directly attached to a garment, there is a risk of damage to the item and to the garment. In another sense, these direct attachment methods limit the items that may be used for decoration on a garment. In particular, when an item is glued to a garment, the glue may damage the fabric of the garment. Unless a large amount of glue is used, the item is usually easily knocked off of the garment. If a large amount of glue is used, it is more likely that the glue will be visible and that the garment will be damaged. Additionally, glue is typically lost during dry cleaning.

When pinning is used to attach a decorative item to a garment, one is severely limited in the types of item that can be used. The item must be something that can be pinned. Further, putting a pin through an item will damage the item at least at the point of puncture. Many times, the garment to be decorated is a formal garment of some kind, such as a wedding gown. These garments are typically made of more delicate fabrics, such as satin and lace. Putting a pin through these fabrics often causes a permanent hole in the fabric where the pin was and weakens the fabric. Moreover, having multiple items pinned over the surface of a garment can be dangerous to the wearer of the garment due to the likelihood of being pricked with one or more pins.

The method of stitching items to a garment is also limited to the use of nonfragile, non-delicate items such as cloth or beads. The use of this method also risks damage to the item and/or to the garment. For example, Candace Kling (1996) teaches the use of crinoline, which resembles cheesecloth, as a backing for decorative items. The crinoline is then tacked to the garment with stitching. Susan Khalje (1997) also teaches sewing fabric flowers directly onto a gown or gluing items, such as sequins, directly onto an outer layer of tulle.

SUMMARY OF THE INVENTION

The present invention overcomes these and other drawbacks of prior methods of suspending decorative items or embellishments on garments by providing an invisible pocket that holds the items without crushing or damaging them and without damaging the garment.

The term garment as used herein is meant to refer to an entire piece of clothing, such as a formal gown or wedding gown, including all of the various layers of various fabrics that may be a part of the garment.

In one aspect, the present invention provides a pocket for suspending an embellishment on a garment comprising. The pocket of the invention generally has a top edge, a bottom edge, a left edge and a right edge. Typically, only the left edge and right edge are stitched to the garment so that the pocket forms an opening to receive the item to be suspended. However, in certain embodiments, the lower edge may be partially or totally stitched to the garment as well, depending upon the item to be suspended on the garment. In this sense, the term "pocket" refers to the piece of fabric depicted in FIG. 1 that is stitched to a larger piece of fabric to form the opening. This piece is also referred to herein as the "outside panel."

When it is said that the pocket is stitched to the garment, it is meant that the pocket is stitched to one of the layers included on the total garment. For example, many formal gowns, such as wedding gowns, are made of delicate fabrics such as satin, chiffon, crepe, tulle, organza, or other delicate fabrics. Often, the "base" design of the gown is covered with layers of lace, organza, tulle, chiffon or other sheer or semi-sheer fabrics. The pocket of the invention will generally be attached to at least one of these outside layers. It is contemplated that the pocket may be stitched to either the outside or the underside (i.e. "garment side") of the layer. In certain embodiments, the layer to which the pocket is stitched will be covered with at least one additional layer of sheer fabric.

In certain embodiments, the pocket of the invention may be trapezoidal in shape. However, it will be well within the ability of one skilled in the art to vary the shape of the pocket as needed for the particular item that skilled artisan desires to suspend on the garment. Typically, the top edge and bottom edge will be slightly curved to enable the pocket to better form the opening to receive the item to be suspended when it is stitched to the garment.

Preferably, the bottom edge of the pocket of the invention will be shorter than the top edge. Since both edges are generally left unstitched, this configuration aids in holding the suspended item within the pocket. However, it is envisioned that in certain situations it may be necessary to stitch along part of the bottom edge starting from each of the outside edges in order to suspend certain items in the pocket. It may alternatively be necessary to stitch along part or all of the bottom edge starting only from one of the outside edges. One of skill in the art will be able to determine whether the bottom edge will need to be stitched at all, either partially or totally, depending upon the item to be suspended on the garment.

In certain preferred embodiments, the top edge may be from about 3 inches to about 15 inches in length. The bottom edge may typically be from about 1 inch to about 14 inches in length. In other embodiments, the bottom edge may be at least about 1 inch shorter in length than the top edge. Preferably, the top edge is about 6 inches in length and the bottom edge is about 1 ¾ inches in length and the left and right edges are about 5 ½ inches in length. Of course, it is not necessary that the left and right edges always be the same length. It is contemplated that a pocket of any size may be used in conjunction with the present invention depending only upon the item to be suspended.

The term "about" in this context means that the measurements may vary slightly from the stated length. For example, the term "about 3 inches" indicates that the length may be slightly shorter than or slightly longer than 3 inches. It is contemplated to encompass variations of up to ½ inch or so. Furthermore, stated ranges, such as "3 to 15 inches" are intended to encompass all intermediate lengths within the range, i.e. 3 ⅛, 3 ¼, 3 ⅜. . . 14 ½, 14 ⅝, 14 ¾, 14 ⅞ etc. The use of increments of ⅛ inch in the example, is not meant to limit the values encompassed within the range to ⅛ inch increments. Thus, lengths such as 3-1/16 inch would also be within the scope of the invention. The term "about" is used to illustrate that the present invention is not limited to an "exact" measurement.

Typically, the pocket of the invention will be made of sheer fabric. In preferred embodiments, the pocket of the invention will be made of tulle or organza. It will be understood that the "back panel" to which the pocket is stitched will generally be of the same sheer fabric as the pocket. Although it is certainly within the scope of the invention to use different sheer fabrics for the pocket and the back panel, depending upon the desired application.

The present invention also provides a garment having one or more invisible pockets as described above for suspending an embellishment. Typically, a garment will have multiple pockets stitched to the same layer of sheer fabric in order to suspend a number of items, such as flowers, over the surface of the garment. However, it is within the scope of the present invention to have pockets stitched to different layers of sheer fabric and/or to have pockets of different sizes stitched to the same garment. These variations in the design of the garment will be well within the ability and the knowledge of one skilled in the art. While it is contemplated that virtually anything may used as an embellishment on a garment of the invention, some preferred items for use in conjunction with the present invention may include flowers, leaves, photos, shells, ribbons, toys, and petals. Most preferably, the embellishment is a flower, such as a rose or a pansy.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1 shows a pattern outline for an embodiment of the outside panel of the pocket of the present invention.

FIG. 2 shows how the pocket is attached to the sheer fabric in order to suspend an item on a garment.

FIG. 3 is a picture of a garment having multiple invisible pockets suspending roses on a wedding gown.

DESCRIPTION OF PREFERRED EMBODIMENTS

The invisible pocket of the present invention is a design technique used to suspend an embellishment, or decorative item, on a sheer fabric without the use of adhesives, pins or permanent stitching as required by current design techniques. The terms "embellishment" and "decorative item" are used interchangeably herein to mean any item that may be suspended on a garment using the pocket of the invention. For example, the inventor contemplates that such items as flowers, shells, leaves, toys, petals, ribbons, beads, and/or pictures or photographs can be used in conjunction with the present invention. However, this list is not meant to be an exhaustive list as it is envisioned that virtually anything one desires to use to embellish a garment may be used in conjunction with the pocket of the present invention. One of skill in the art need only adjust the size and/or shape of the pocket in order to accommodate the item to be suspended on the garment. A person skilled in the art of garment design and manufacture can easily determine the size or shape adjustments necessary to suspend any item they so desired on the garment.

In preferred embodiments, the invisible pocket of the present invention is typically a triangular or trapezoidal piece of sheer fabric, cut with a curved upper and lower edge. This piece is the outside panel of the pocket. The term "curved" as used herein generally means that the edges are slightly less than a straight line. However, it is envisioned that the upper and lower edges could be straight in certain embodiments, such as for use with an embellishment that is more flat. In this situation, the difference in the lengths of the upper and lower edges would most likely be greater in order to hold the embellishment in the pocket.

Figure 1:
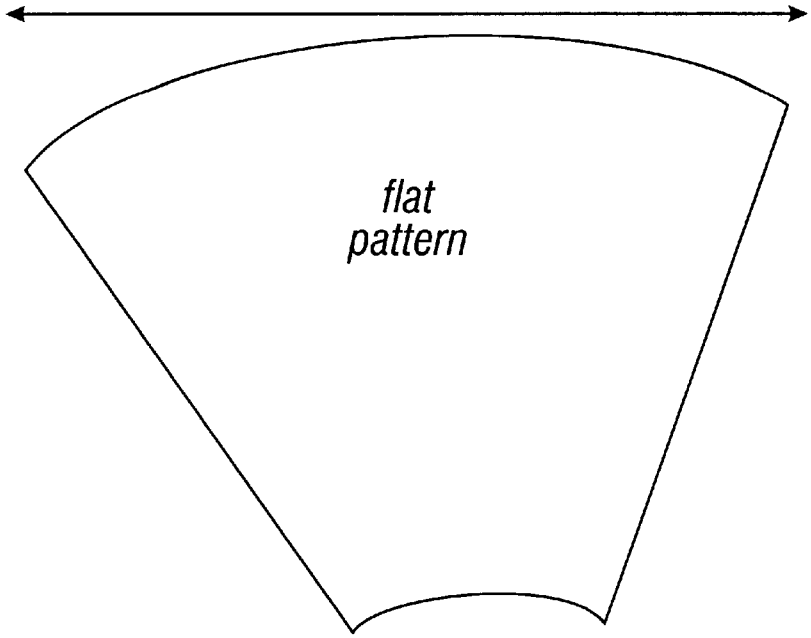
FIG. 1.
Figure 2:
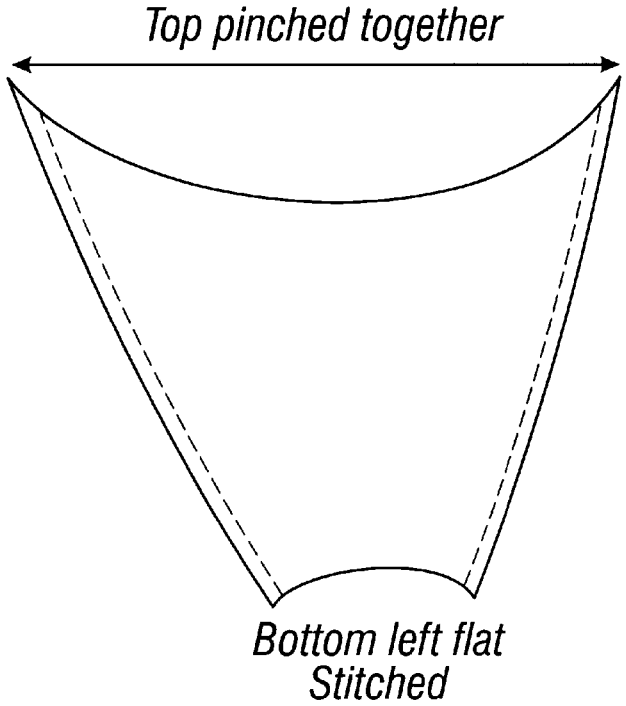
FIG. 2.
Figure 3:
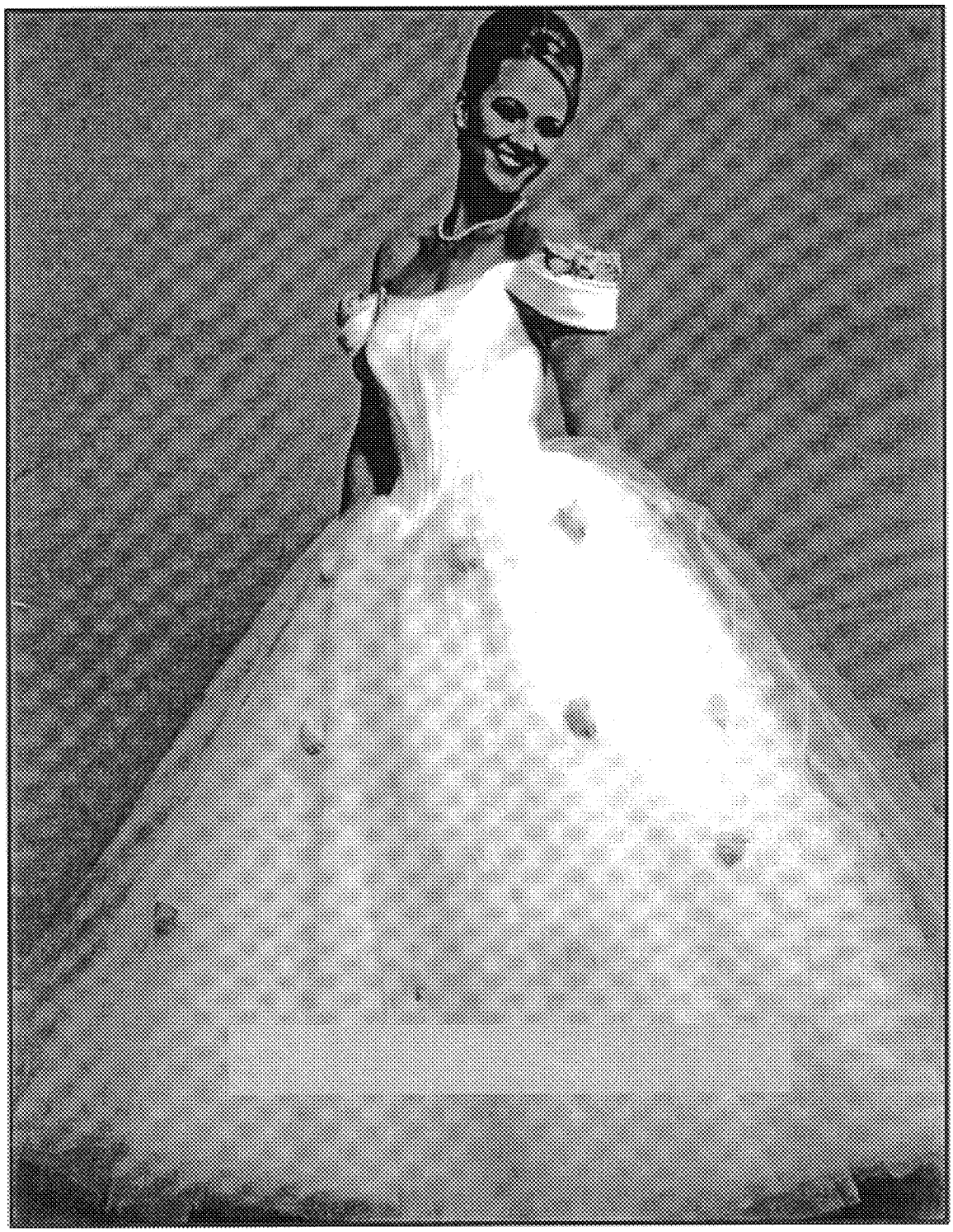
FIG. 3.

This outside panel is stitched to another layer of sheer fabric, the back panel, and forms an invisible open-ended pouch. As can be seen in FIG. 2, the outside panel is typically stitched to the back panel in such a way that the pocket forms an opening to receive the item to be suspended. That is, the outside corners of the upper edge are generally not stretched out flat when stitched, but rather are stitched close enough together so that a pouch or opening forms to receive the embellishment. However, in other embodiments, the outside panel may be stitched to the back panel so as to form a flat pocket to suspend narrower items. In fact, the total size of the pocket and distance between the straight left and right edges when stitched to the back panel may be adjusted according to the size of the item to be suspended. Additionally, in certain embodiments, the lower edge may be partially or totally stitched to the back panel as well. By partially stitched, it is meant that less than the full length of the lower edge may be stitched.

It is contemplated that various items can be suspended into or onto a garment using the pocket of the invention. The unique curved shape and the use of clear thread help to conceal the pocket on the garment, thus making it "invisible" to a casual observer. When additional layers of tulle are placed over the existing pocket layer, the invisible construction creates an illusion of floating objects on the garment.

It is also contemplated that the pocket, or outside panel, need not necessarily be stitched to the outside of the layer that is the back panel. It may conceivably also be stitched to the underside, or side that is toward the garment itself, of the layer of the sheer fabric which is the back panel. In this way, one might avoid having additional layers of sheer fabric on the outside of the pocket.

The invisible pocket of the invention is currently used to hold a flower or other object in place without the need for stitching or gluing the object, as has been done in prior art methods of suspending an embellishment on a garment. This enables the wearer to remove the suspended flowers for alterations, cleaning and storage of the garment. This application is quite unique to the garment industry. The ability to insert and remove an object without the use of permanent adhesives represents a dramatic improvement over previously known methods of garment embellishment.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such substitutions and modifications apparent to those skilled in the art are deemed to be within the spirit, scope and concept of the invention as defined by the appended claims.

REFERENCES

The following references, to the extent that they provide exemplary procedural or other details supplementary to those set forth herein, are specifically incorporated herein by reference.

Khalje, Susan, Bridal Couture, pp. 3126–3127 (1997).

Kling, Candace, The Artful Ribbon, p. 177 (1996).

What is claimed is:

1. A pocket for suspending an embellishment on a garment comprising:

a top edge;

a substantially unstiched bottom edge;

a substantially unstiched left edge; and a right edge;

wherein said pocket comprises a sheer fabric and wherein said left edge and said right edge are stitched to a layer of sheer fabric so that said pocket forms an opening to receive the item to be suspended.

2. The pocket of claim 1, wherein said pocket is trapezoidal.

3. The pocket of claim 2, wherein said top edge and said bottom edge are slightly curved.

4. The pocket of claim 2, wherein said bottom edge is shorter than said top edge.

5. The pocket of claim 4, wherein said top edge may be from about 3 inches to about 15 inches in length.

6. The pocket of claim 5, wherein said bottom edge may be from about 1 inch to about 14 inches in length.

7. The pocket of claim 5, wherein said bottom edge is at least about 1 inch shorter in length than the top edge.

8. The pocket of claim 6, wherein the top edge is about 6 inches in length and the bottom edge is about 1 ¾ inches in length.

9. The pocket of claim 8, wherein the left edge is about 5 ½ inches in length and the right edge is about 5 ½ inches in length.

10. The pocket of claim 1, wherein said sheer fabric may be tulle, chiffon, crepe or organza.

11. The pocket of claim 10, wherein said pocket is made of tulle.

12. The pocket of claim 1, wherein a portion of said bottom edge is stitched to the garment.

13. A garment having one or more invisible pockets for suspending an embellishment, said garment comprising:

at least one layer of sheer fabric;

at least one invisible pocket attached to a layer of said sheer fabric; and at least one embellishment suspended in said pocket;

wherein said pocket comprises a substantially unstiched top edge;

a substantially unstiched bottom edge;

a left edge; and a right edge;

wherein said left edge and said right edge are stitched to said sheer fabric so that said pocket forms an opening to receive the embellishment to be suspended.

14. The garment of claim 13, further comprising at least one layer of sheer fabric covering the layer of sheer fabric to which the pocket is attached.

15. The garment of claim 13, wherein said embellishment may be selected from the group consisting of a flower, a leaf, a photo, a shell, a ribbon, a toy, and petals.

16. The garment of claim 15, wherein said embellishment is a flower.

17. The garment of claim 13, comprising more than one invisible pocket attached to the same layer of sheer fabric.

18. The garment of claim 13, comprising two or more layers of sheer fabric having at least one invisible pocket attached thereto.

* * * * *

UNITED STATES PATENT AND TRADEMARK OFFICE

CERTIFICATE OF CORRECTION

PATENT NO. : 6,131,205

DATED : October 17, 2000

INVENTOR(S) : Arem

It is certified that error appears in the above-identified patent and that said Letters Patent is hereby corrected as shown below:

In claim 1, column 5, line 17, please insert -- substantially unstitched -- before "top edge" therefor.

In claim 1, column 5, line 19, before "left edge" please delete -- substantially unstiched -- therefor.

In claim 13, column 6, line 18, please delete "unstiched" and insert -- unstitched -- therefor.

In claim 13, column 6, line 18, please delete "unstiched" and insert -- unstitched -- therefor.

In the specification, column 2, line 2, please delete "comprising" therefor.

In the specification, column 3, line 28, please delete "may used" and insert -- may be used -- therefor.

Signed and Sealed this

First Day of May, 2001

*Attest:*

Nicholas P. Godici

NICHOLAS P. GODICI

*Attesting Officer*

*Acting Director of the United States Patent and Trademark Office*